United States Patent [19]

Ruble

[11] 4,165,624

[45] Aug. 28, 1979

[54] AUTOMATIC WASHER OPERATING APPARATUS

[75] Inventor: Ernest B. Ruble, South Haven, Mich.

[73] Assignee: Whirlpool Corporation, Benton Harbor, Mich.

[21] Appl. No.: 882,854

[22] Filed: Mar. 2, 1978

[51] Int. Cl.[2] ..... D06F 23/04; D06F 37/40

[52] U.S. Cl. ..... 68/23.7; 192/48.4

[58] Field of Search ..... 68/23.6, 23.7; 192/48.4

[56] References Cited

U.S. PATENT DOCUMENTS

| | | | |
|---|---|---|---|
| 2,331,897 | 10/1943 | Dyer | 68/23.7 X |
| 2,511,681 | 6/1950 | Young et al. | 68/23.7 X |
| 2,625,248 | 1/1953 | Geldhof et al. | 192/116.5 |
| 2,733,610 | 2/1956 | Lodge | 68/23.7 X |
| 2,826,056 | 3/1958 | Bruckman | 68/23.7 |
| 2,869,698 | 1/1959 | Conlee | 68/23.7 X |
| 3,076,349 | 2/1963 | Williams et al. | 68/23.7 X |
| 3,215,232 | 11/1965 | Douglas | 68/23.7 X |
| 3,279,223 | 10/1966 | Severance et al. | 68/23.7 X |

*Primary Examiner*—Philip R. Coe

*Attorney, Agent, or Firm*—Hill, Van Santen, Steadman, Chiara & Simpson

[57] ABSTRACT

A simplified arrangement for alternately operating an agitator and a spinning clothes container in a laundry machine. A container driving member and an agitator driving gear are both mounted rotatably and reciprocably on the agitator shaft, and a shifter selectively effects concurrent driving clutching engagement between the container and the container driving member and declutching of the gear from the shaft, and alternatively the shifter controls the container driving member to declutch from the clothes container and concurrently controls the driving gear to enter into clutching driving relation to the agitator shaft. Improvements in mechanism include the shifter assembly, an anti-clash device for the gear clutch, an inertial spring clutch for the container driving member, an agitator spin drive snap ring and spring clutch, and load sensitive brake and clutch means for the clothes container.

14 Claims, 14 Drawing Figures

AUTOMATIC WASHER OPERATING APPARATUS

BACKGROUND OF THE INVENTION

1. Field of the Invention

This invention relates to improvements in laundry machines especially of the automatic washer type wherein a clothes container adapted to spinning rotation is mounted within a tub, an agitator is mounted within the clothes container, and the clothes container and the agitator are alternatively selectively operable in an automatic washing, rinsing and spin dry cycle.

2. Description of the Prior Art

Numerous and varied apparatus have been provided heretofore to effect automatic washer cycling, such apparatus being generally fairly complicated, employing large numbers of parts, complex clutching and braking arrangements and control devices liable to failure.

Typical prior apparatus over which the present invention provides substantial improvements is found in Geldhof et al, U.S. Pat. No. 2,625,248, which discloses an arrangement wherein two shifter bars are employed, one for controlling operation of the agitator shaft, and the other for controlling operation of the clothes container or perforated basket. Two control solenoids are necessary for the two shifter bars. A fairly complex clutch and brake arrangement is disclosed for controlling the spinning and stationary modes of the clothes container.

Another characteristic of prior structures has been the frequent use of tension springs in controlling operation of various mechanism. Not only is the use of such a spring depicted in the aforesaid U.S. Pat. No. 2,625,248, but also, typically in Conlee U.S. Pat. No. 2,869,698. Tension springs are notoriously unreliable and subject to breaking where placed under repeated stress.

SUMMARY OF THE INVENTION

An important object of the present invention is to provide a new and improved laundry machine of the automatic cycling type which will overcome the disadvantages, drawbacks, inefficiencies, shortcomings and problems inherent in prior machines of this kind.

Another important object of the invention is to provide simplified, efficient, reliable operating apparatus for automatic laundry machines of the type having a spin dry clothes container and an agitator.

The present invention provides an improved operating apparatus for laundry machines of the type including a tub, a clothes container within the tub mounted for spinning rotation at a relatively high extraction speed, and an agitator mounted within the clothes container for oscillating movement relative to the clothes container. In the preferred form of the present invention, an agitator shaft has a driving gear mounted for oscillation and reciprocation on and relative to the shaft. There is also a container driving member such as a pulley mounted rotatably and reciprocatingly on the agitator shaft. Clutch means carried in part by the driving gear and in part by the shaft effects a driving coupling selectively between the driving gear and the shaft. Separable clutch means effect container spinning connection between the container and the container driving member. The driving gear is continuously oscillated and the container driving member is continuously rotated. Shifter means is operable for shifting the driving gear and the driving member axially along the shaft in one common reciprocative direction for declutching the driving gear from the shaft to discontinue agitator driving action of the shaft and for concurrently effecting driving clutching connection of the driving member with the container for spinning operation of the container. The shifter means is alternatively operable to effect shifting of the driving member in the opposite reciprocative direction to declutch and discontinue spinning operation of the container and concurrently to effect shifting of the gear member in the same reciprocative direction to effect clutching connection with the agitator shaft for oscillation of the shaft and the agitator. Thus, a single shifter bar controls both of the container driving member and the agitator shaft driving gear by simple concurrent reciprocative movements axially along the agitator shaft. In addition to improved shifter mechanism there is provided a novel anti-clash device for the agitator shaft driving gear clutch, a novel inertial spring clutch for the clothes container driving rotary member, a novel agitator spin drive snap ring and spring clutch, and improved load sensitive brake and clutch means for the clothes container.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

DESCRIPTION OF A PREFERRED EMBODIMENT

Figure 1:
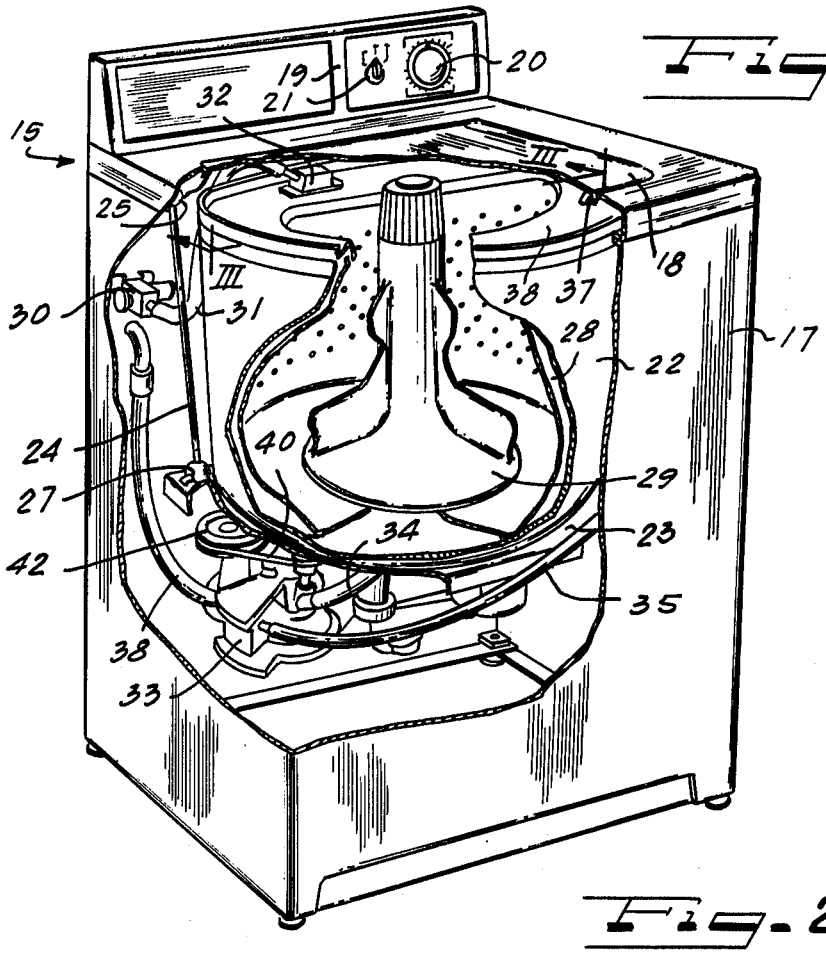
FIG. 1 is a perspective view, partly broken away, of an automatic washing machine embodying the invention.
Figure 2:
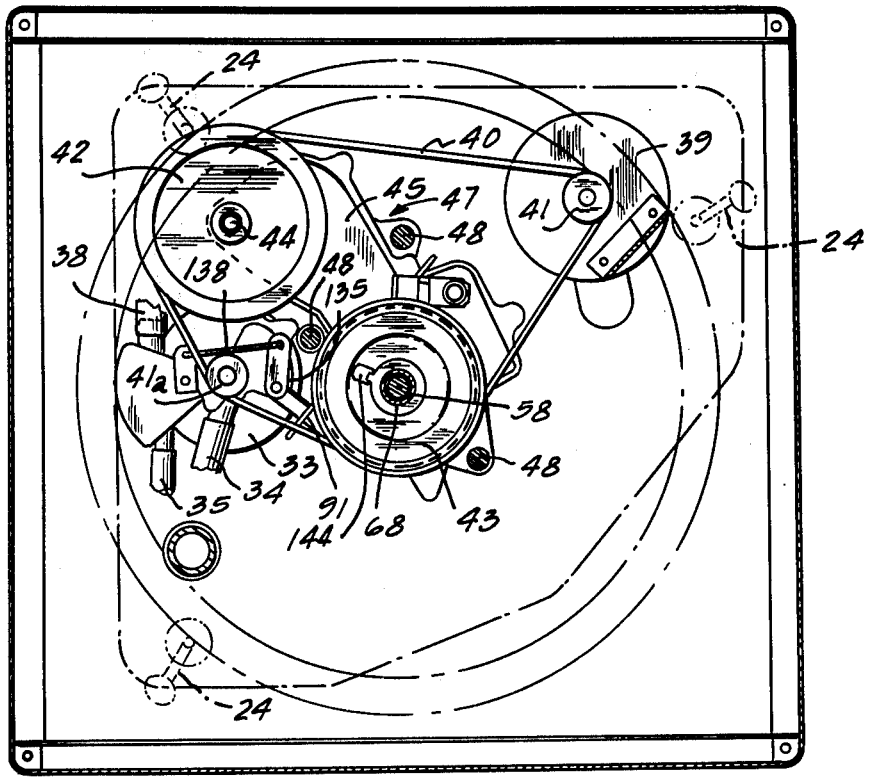
FIG. 2 is a horizontal sectional plan view taken substantially along the line II—II in FIG. 3.
Figure 3:
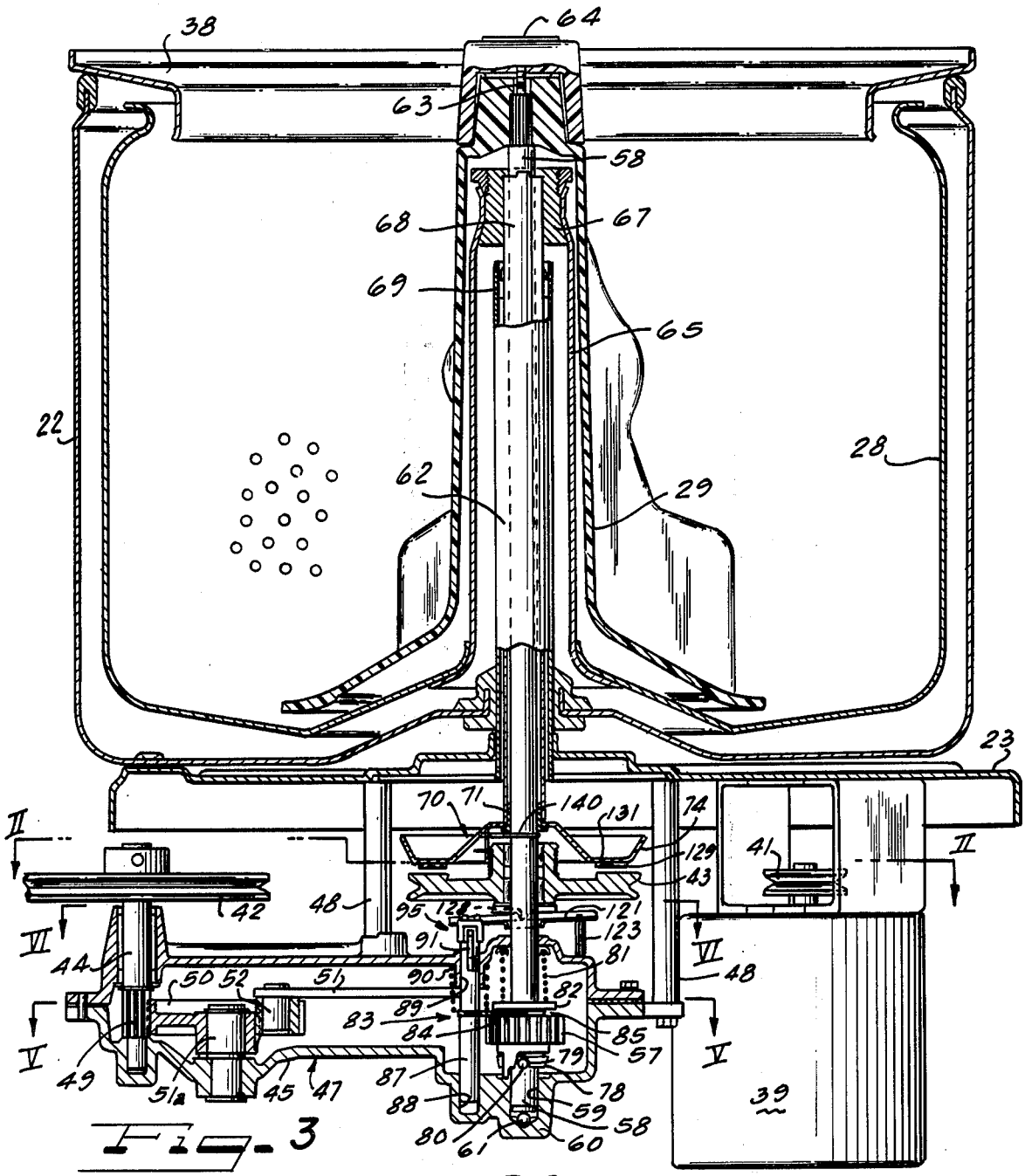
FIG. 3 is an enlarged vertical sectional detail view taken substantially along the line III—III of FIG. 1.

Having reference to FIGS. 1–3, a laundry machine 15 of the domestic automatic clothes washer type, comprises a cabinet and frame assembly 17 having a customary hinged lid 18 permitting access into the top of the unit. Back of the lid 18 is a console 19 having a readily accessible timer dial 20 and a program selector 21.

Within the housing or cabinet 17 is an imperforate tub 22 which is supported by means of a base plate 23 suspended by suspension rods 24 having resilient upper cushioning connections 25 with the top of the cabinet 17 and similar resilient cushioning connections 27 with the plate 23.

A perforate washing basket or clothes container 28 is mounted for spinning actuation concentrically within the tub 22. Concentrically within the container 28 an agitator 29 is mounted for clothes washing agitation.

Wash water is adapted to be introduced into the tub 22 by means of a solenoid-controlled inlet valve 30, a flexible conduit 31 and an anti-siphon device 32. During the agitate phase of a washing cycle wash water is adapted to be recirculated by means of a pump assembly 33 communicating with the bottom of the tub 22 through a withdrawal conduit 34 and returning the wash water to the top of the tub through a conduit 35 delivering through a filter 37 on a tub ring 38. A drain conduit 38 leads from the pump assembly 33 to be connected to a drain, not shown.

Figure 5:
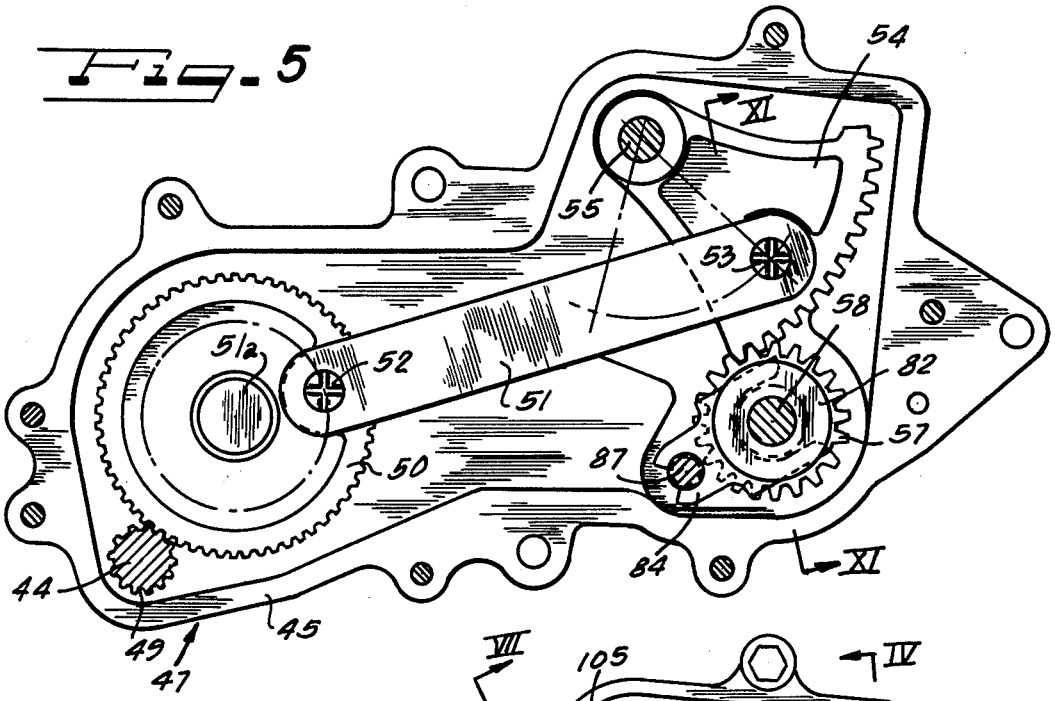
FIG. 5 is an enlarged fragmentary sectional plan view taken substantially along the line V—V of FIG. 3.

Not only the pump 33, but also means for operating the pump, the container 28 and the agitator 29 are supported by and under the base plate 23, and including a prime mover 39, e.g., an electric motor which powers a transmission through an endless driving element 40 such as a flexible belt trained over a pulley 41 keyed to the drive shaft of the motor. Continuously rotatably driven by the belt 40 while the motor 39 is energized and operative is a pump driving pulley 41*a*, an oscillation transmission driving pulley 42 and a container driving member pulley 43. As best visualized in FIGS. 2, 3 and 5, the pulley 42 is mounted on a vertical shaft 44 journaled in a housing 45 of an oscillation transmission unit 47 suspended from the base plate 23 by means of suspension rods 48. Gear teeth formed on the shaft 44 provide a pinion 49 meshing with a spur gear 50 rotatably mounted on a stub shaft 51*a* carried by a housing 45. A link or crank arm 51 has one end connected relatively rotatably to the gear 50 by means of an axle pin 52 and its opposite end pivotally connected by means of an axle pin 53 or the like to a sector gear 54 oscillatably mounted on a pivot 55 carried by the housing 45. The sector gear 54 meshes with a driving gear 57 mounted for oscillation and reciprocation on and relative to a vertical agitator driving shaft 58 which has its lower end journaled in a bearing bore 59 (FIG. 3) in a depending boss 60 on the housing 45, an anti-friction thrust bearing 61 being deposed under the lower end of the shaft. Through this arrangement, rotation of the pulley 42 causes operation of the oscillation transmission to continuously oscillate the driving gear 57 while the motor 39 is drivingly energized.

From the gear case or housing 45, the agitator shaft 58 projects upwardly through a hollow tubular center post 62 carried fixedly by the base plate 23. At a suitable height above the center post 62 the shaft 58 has secured thereto as by means of a screw 63 a crown coupling portion 64 at the upper end of the hollow agitator 29. Freely concentrically located between the hollow agitator 29 and the center post 62 is a hollow upwardly projecting center support tube 65 of the clothes container 28. At its upper end the support tube 65 has fixedly secured thereto a collar 67 which is press fitted or otherwise fixedly secured to the upper end of a clothes container drive tube 68 of a diameter to extend freely downwardly about the shaft 58 and within the center post 62, there being a sleeve bearing 69 within the upper end of the center post 62 for rotatably journalling the drive tub 68 extending therethrough. At its lower end of the drive tube 68 extends below the base plate 23 and has fixedly secured thereto and corotatable therewith a combination clutch and brake disk 70. Through this arrangement, the agitator shaft 58 is adapted to be oscillatably driven to oscillate the agitator 29 relative to the clothes container 28 and the clothes container 28 is adapted to be rotated in a spin mode by rotary driving of the drive tube 68 through the disk 70. A sleeve bearing 71 maintains the lower end of the drive tube 68 and the disk 70 in concentric relative rotatable relation about the shaft 58.

In the at rest mode of the clothes container 28, it is held substantially stationary by means of one or more, in this instance one, brake shoe 72 (FIGS. 4 and 11) mounted on top of the gear case 45 and having a brake lining type of friction pad 73 which is brakingly engageable by a generally upwardly and outwardly oblique annular marginal brake flange 74 on the disk 70. In a desirable form, the brake shoe 72 is mounted on a rigid supporting standard 75 secured as by means of bolts 77 to a gear case 45. The relationship of the brake shoe 72 to the brake disk flange 74 is such that there is a simple gravity engagement of the brake disk with the brake shoe. That is in the stationary mode of the clothes container 28 its weight is transmitted through the support tube 65 and the drive tube 68 to the disk 70 which through its brake flange 74 rests on the friction pad 73 of the brake shoe 72 and thereby not only supports the clothes container 28 but resists rotation or spinning of the clothes container efficiently during the washing cycle in which the agitator 29 is oscillated in clothes washing mode.

Clutch means carried in part by the driving gear 57 and in part by the agitator shaft 58 are adapted to effect a driving coupling selectively between the driving gear and the shaft. To this end, the gear 57 has a depending hub portion 78 (FIG. 3) provided with diametrically opposite downwardly opening clutch jaws 79 within which is received a transverse clutch pin 80 fixed on the shaft 58. Normally a coiled compression biasing spring 81 mounted about the shaft 58 and thrusting at its upper end against the inside of the gear case 45 and at its lower end against an upwardly projecting hub portion 82 of the gear 57, urges the gear in clutching direction.

For declutching the gear 57 when it is desired to stop operation of the agitator 29, shifter means 83 is operated, comprising a gear shifting fork 84 engaged in an annular groove 85 in the upper hub portion 82 and rigid with a vertically extending fork shift rod 87 having its lower end slidably engaged in an upwardly opening socket 88 in the portion 60 of the gear case housing 45. Above the shifter fork 84, the rod 87 extends upwardly through a bearing bore 89 provided by the upper portion of the gear housing 45 suitably adjacent to and parallel to the shaft 58. Biasing means comprising a coiled compression spring 90 thrusting in its upper end against the gear case housing and at its lower end against the shifter fork 84 cooperates with the biasing spring 81 to normally bias the shifter rod 87 in the direction of the clutching cooperation of the gear 57 with the shaft 58.

Means for operating the shifter means 83 for declutching the gear 57 comprise a cam bar 91 (FIGS. 3 and 6–10) which is horizontally elongated and flat in its substantial vertical dimension and extends through an axially upwardly opening guide slot 92 in the upper portion of the fork shift rod 87. An operating connection between the rod 87 and the bar 91 is effected by means of a follower assembly 95 carried by the upper end portion of the rod 87 and comprising a follower roller 97 which rides the upper edge of the cam bar 91. Mounting of the roller 97 above the upper edge of the bar 91 within the slot 92 is effected by means of an axle 98 which clears through a transverse upwardly opening slot 99 in the upper end of the rod 87 and transverse to the slot 92. A frame collar member 100 encircles the upper end portion of the rod 87 about the slot 99 and has the opposite ends of the axle 98 press fitted thereto. Means for retaining the frame sleeve 100 comprise a snap ring 101 engaged in a locking groove 102 provided therefor substantially in the line with the upper edge of the frame sleeve 100. Diametrically aligned slots 103 in the lower portion of the frame sleeve 100 and aligned with the rod slot 92 provide clearance for the upper margin of the bar 91. As best visualized in FIGS. 3 and 7, in the clutch driving relation of the gear 57 and the shaft 58, the follower roller 97 is accommodated at the bottom of a diagonal cam edge surface in an upwardly opening notch 104 in the cam bar 91.

Operation of the cam bar 91 is effected automatically during a working cycle of the washing machine 15 in response to control means including a wig-wag assembly 105 (FIGS. 6, 7 and 8) associated with one end portion of the bar 91 and comprising a solenoid 107 mounted in adjacently spaced overlying relation to the bar 91 on the distal end portion of a cantilever arm 108, the proximal end portion of which arm is fixedly secured to the upper end portion of the oscillating shaft 55 to which the sector gear 54 is fixed. Therefore as the sector gear 54 is oscillated, the arm 108 is correspondingly oscillated to swing the solenoid 107 in a back and forth oscillating movement within a range exemplified by the dot dash lines 108 in FIG. 6. As the solenoid 107 swings back and forth, in the de-energized condition of the solenoid a control pin 110 mounted across a yoke 111 connected to the lower end of armature 112 of the solenoid is caused to reciprocate throughout the length of a lower longitudinal control slot 113 in the bar 91 between a rear end stop 114 and a front end stop shoulder 115. In this relationship of the parts, then, the pin 110 continues to idle reciprocatingly in the slot 113 until the time in the operating cycle in the washing machine is reached where it is desired to declutch the driving gear 57 from the shaft 58 and to initiate a spin cycle for the clothes container 28.

The spin cycle is inititated by energizing of the solenoid 107 which causes the control pin 110 to be shifted upwardly and when the pin reaches the forward end stop 115 of the control slot 113 in the bar 91 the pin 110 shifts upwardly and is received in the rear end of a forwardly extending control slot 117 offset upwardly from the front end of the lower control slot 113 and with a sufficient overlap of the adjacent end portions of the slots 113 and 117 to provide a transfer clearance gap 118 for the pin 110. On being lifted into the slot 117, the pin 110 opposes a shoulder 119 at the rear end of the control slot 117 and as the solenoid is swung rearwardly drives the shoulder 119 and thereby the cam bar 91 rearwardly, that is toward the left as viewed in FIG. 8. This causes the follower roller 97 to ride up the cam edge **103*a* onto the top horizontal edge of the bar 91. This raises the shifter rod 87 against the compression spring 90 and correspondingly lifts the shifter fork 84 and raises the gear 57 in the upward reciprocative direction against the biasing spring 81 whereby to declutch the gear 57 from the agitator shaft 58. While the solenoid 107 remains energized, the pin 110 idles between the shoulder 119 and a front end 120 of the slot 117**.

Figure 6:
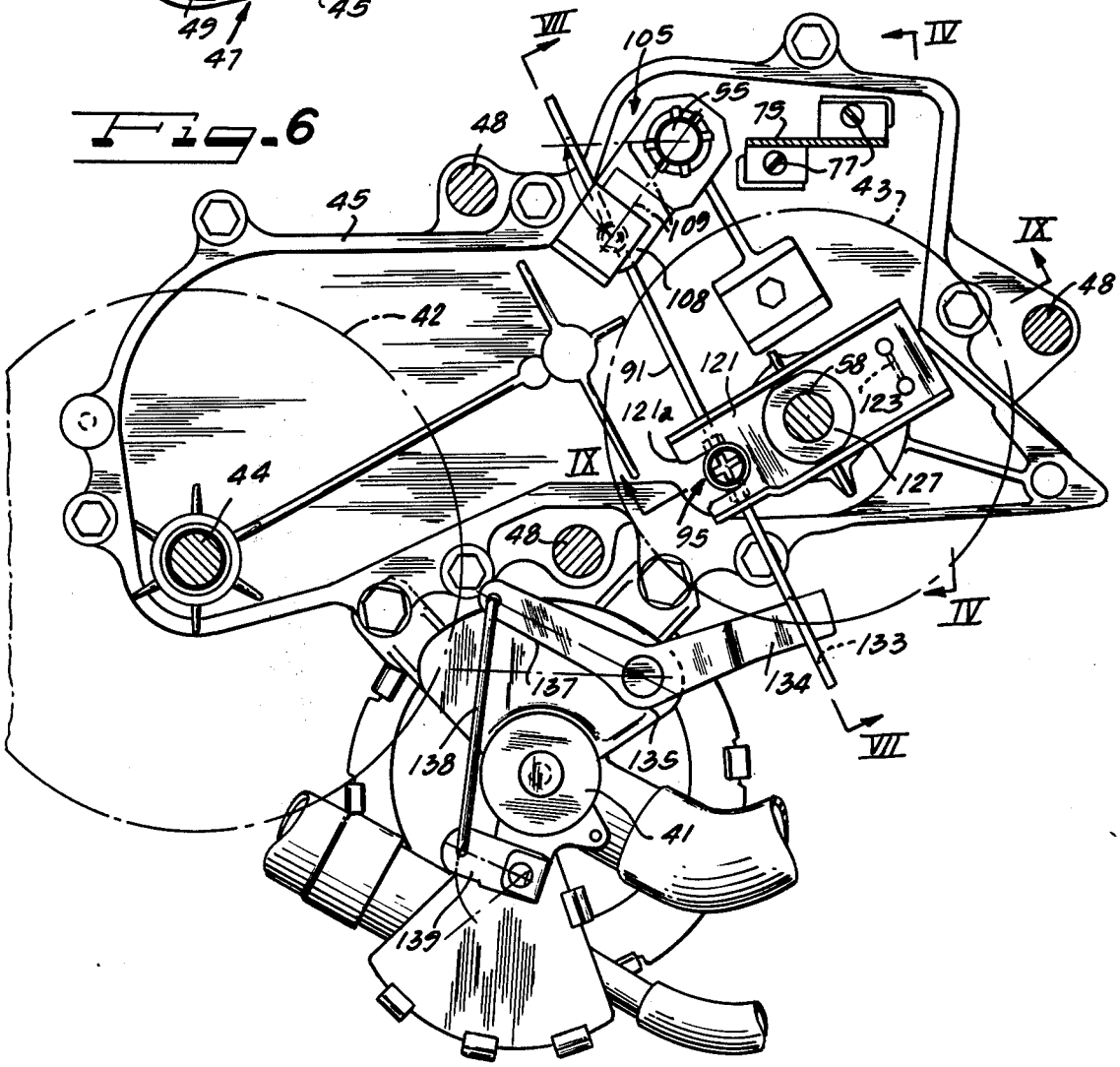
FIG. 6 is an enlarged sectional plan view taken substantially along the line VI—VI of FIG. 3.
Figure 7:
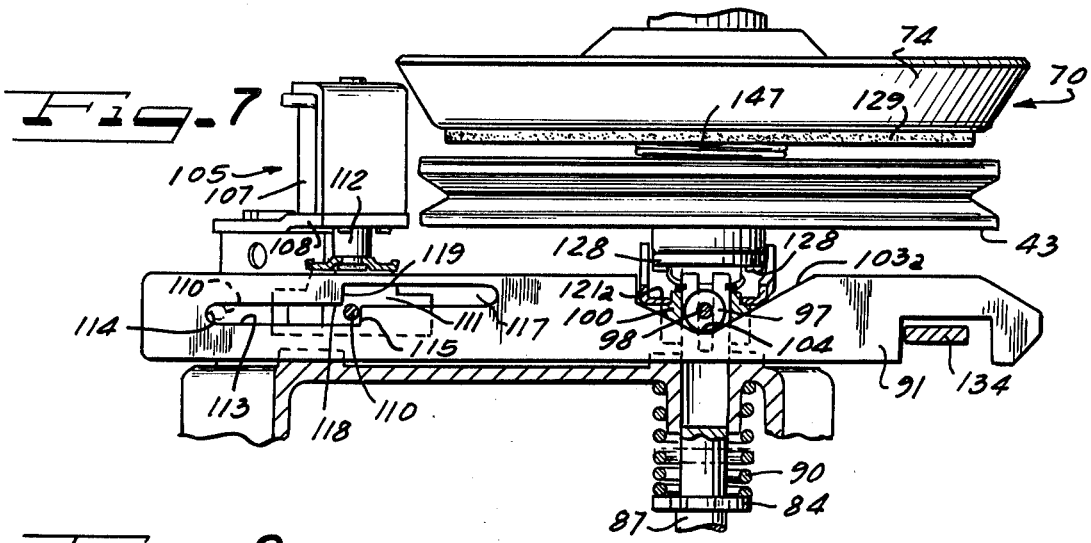
FIG. 7 is a vertical sectional detail view taken substantially along the line VII—VII of FIG. 6.
Figure 8:
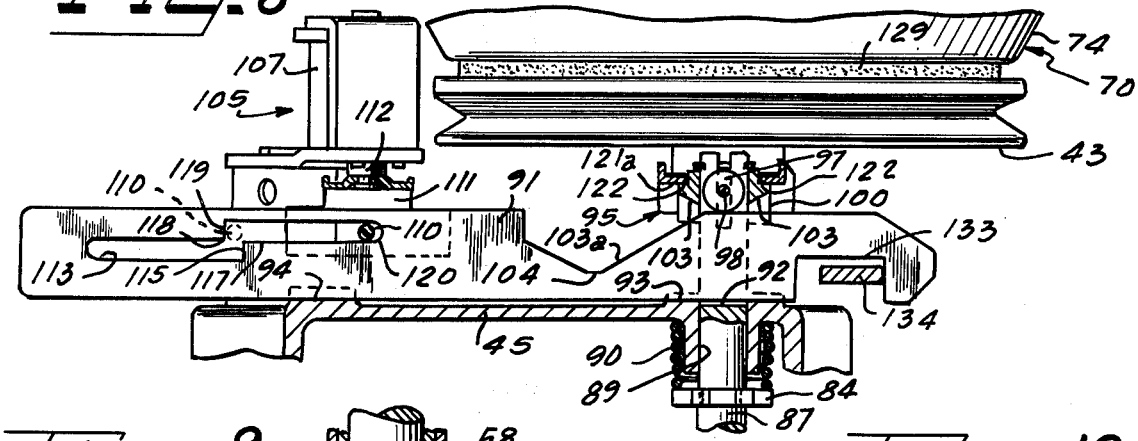
FIG. 8 is a view similar to FIG. 7 but showing the mechanism in a different operating mode.
Figure 9:
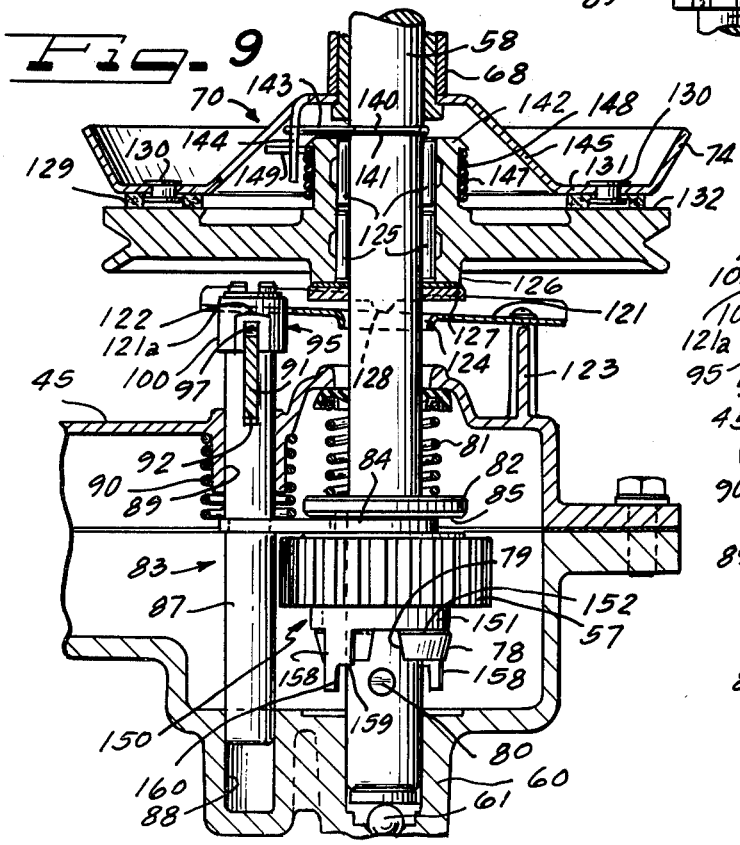
FIG. 9 is a sectional elevational detail view taken substantially along the line IX—IX of FIG. 6.
Figure 10:
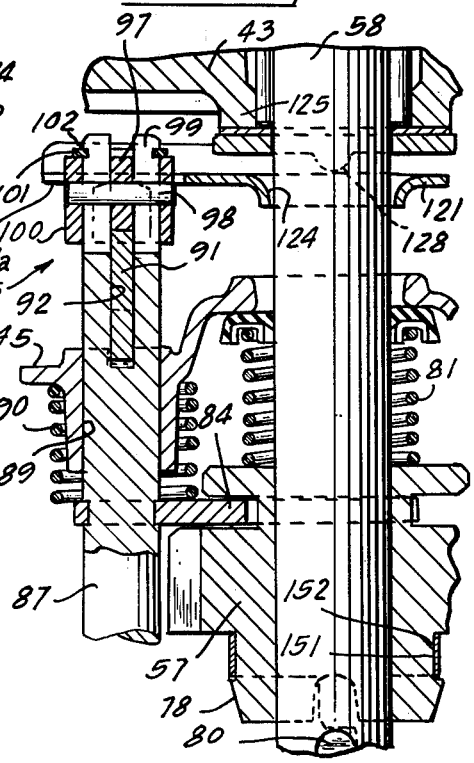
FIG. 10 is a view similar to FIG. 9 but showing certain details to better advantage.

Concurrently with declutching of the gear 57, the shifter means 83 effects a driving clutching connection of the driving member 43 with the clothes container 28 for spinning operation of the container. For this purpose a shifter yoke 121 conveniently in the form of a rigid channel shape lever bar has a bifurcated end portion **121*a* (FIGS. 6, 9 and 10) engaged on fulcrum shoulders 122 on opposite sides of the frame sleeve 100 over the slots 103 (FIGS. 8 and 9). At its opposite end portions the yoke bar 121 is freely fulcrumed on an upstanding fulcrum projection 123 which may be formed integrally with the top of the gear case 45. Intermediately the yoke bar 121 has a flange reinforced clearance opening 124 through which the shaft 58 extends. Thereby, the shifter yoke bar 121 underlies, in diametric relation, the container driving pulley member 43 which is mounted for rotation and reciprocation on and relative to the shaft 58 by means of anti-friction bearings 125 within hub 126 of the pulley 43 which has secured to its lower end a combination bearing retainer and fulcrum plate 127 provided with downwardly projecting limited contact, preferably rounded fulcrum bearings 128 which engage the intermediate portion of the shifter bar 121. Through this arrangement, the container driving pulley 43 is adapted to be raised by the follower assembly 95 from a position spaced below the clutch and brake disk 70 during the agitator driving mode of the apparatus, as shown in FIG. 7, to a clothes container spinning clutching engagement with the disk 70 as shown in FIGS. 8 and 9. Clutching engagement between the driving pulley 43 and the disk 70 is enhanced by means of a clutch ring 129 of suitable friction material attached as by means of rivets 130 concentrically to an annular downwardly facing clutch surface 131 of the disk 70 inwardly from the brake flange 74. An annular clutch surface 132 on the upper side of the pulley 43 clutchingly engages with the clutch ring 129 in the clutching relation of the pulley to the clutch disk. It may be noted that the extent of vertical movement, that is upward reciprocative movement of the pulley 43 along the shaft 58 imparted by the shifter bar 121, is such that the disk 70 is raised sufficiently to disengage the brake drum flange 74 from the brake shoe 72, substantially as indicated in dash outline in FIG. 4. As a result the disk 70 and thereby the sleeve shaft 68, the support tube 65 and the clothes container 28** are caused to enter into the spin mode operation.

At the same time as the control cam bar 91 is shifted to effect clutching connection of the continuously rotating driving pulley 43 with the clothes container 28, for spinning operation of the container, the bar 91 is also effective to operate the pump 43 to pump out water from the tub 22. For this purpose the front end portion of the bar 91 has a downwardly opening notch 133 within which is engaged an arm 134 (FIGS. 6, 7 and 8)

of a bell crank lever 135 pivoted on the pump casing and having its other arm 137 connected by means of a link 138 to a pump control lever 139. consequently, since the clutch drive through the continuously rotating pulley 43 and the clutch disk 70 is a load sensitive spin dry arrangement, as the water is pumped out of the tub 22, the torque on the spin dry clutch increases until the wet clothes load rests on the bottom of the basket 28, thus providing a built-in torque limiting system that reduces wear on the clutch and also reduces torque on the motor while pump-out is occurring. After pump-out the wash load is spun at design speed.

When the drive system of the machine 15 is shifted into the spin mode, it is, of course, desirable for the agitator shaft 58 and the agitator 29 to spin with the basket 28. To this end, means are provided for effecting a clutching connection between the clutch disk 70 and the shaft 58, herein comprising a frictional snap ring 140 (FIG. 9) seated in a shallow groove 141 in the shaft 58 above an upper hub portion 142 of the driving pulley 43. When the pulley 43 is lifted into clutching relation to the clutch disk 70, the upper end of the hub portion 142 engages the ring 140 as a stop and slightly lifts the shaft 58 whereby to relieve pressure on the thrust bearing 61 and avoid any possible resistance to free rotation of the shaft 58 after it has been declutched relative to the driving gear 57. At the same time, a clutch finger extension 143 on the friction ring 140 engages a downwardly extending clutch finger 144 lanced from and depressed downwardly relative to a cone portion 145 of the disk 70 providing a chamber space within which the hub 142, the spring friction clutch ring 140 and finger 143 and clutch finger 144 are accommodated. During the wash cycle in which the shaft 58 and thereby the agitator 29 oscillate, the combination snap ring and clutch spring 140 by virtue of its frictional grip about the shaft 58 oscillates back and forth with the shaft. During the spin mode of the machine in which the agitator shaft 58 is declutched from the driving gear 57, the ring 140 permits lifting of the shaft 58 to facilitate free rotation of the shaft, and the spring finger 143 is engaged by the clutch disk finger 144 which causes the agitator shaft 58 to rotate during the entire spin cycle. It may be observed that the combination snap ring and clutch spring 140 provides a simple low cost device assuring positive agitator shaft driving in the spin mode of the washing machine operation. Because of its resilient frictional slipping capability, the ring 140 cannot be overloaded and broken.

Figure 4:
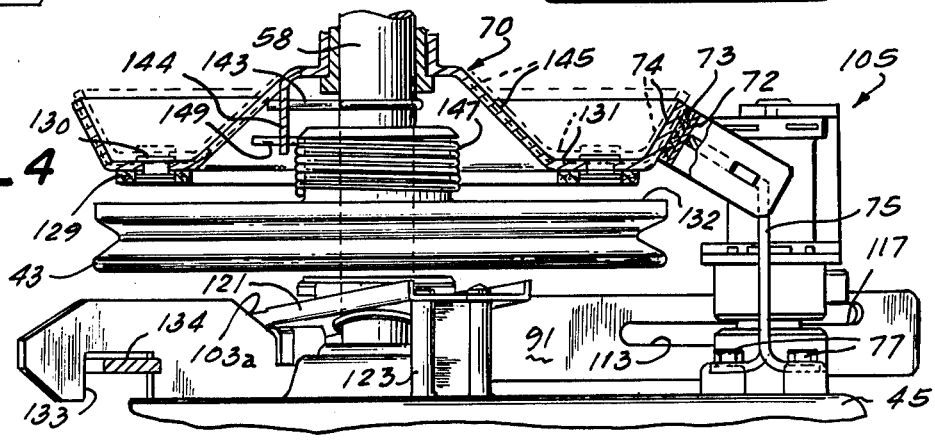
FIG. 4 is a sectional elevational detail view taken substantially along the line IV—IV of FIG. 6.
Figure 11:
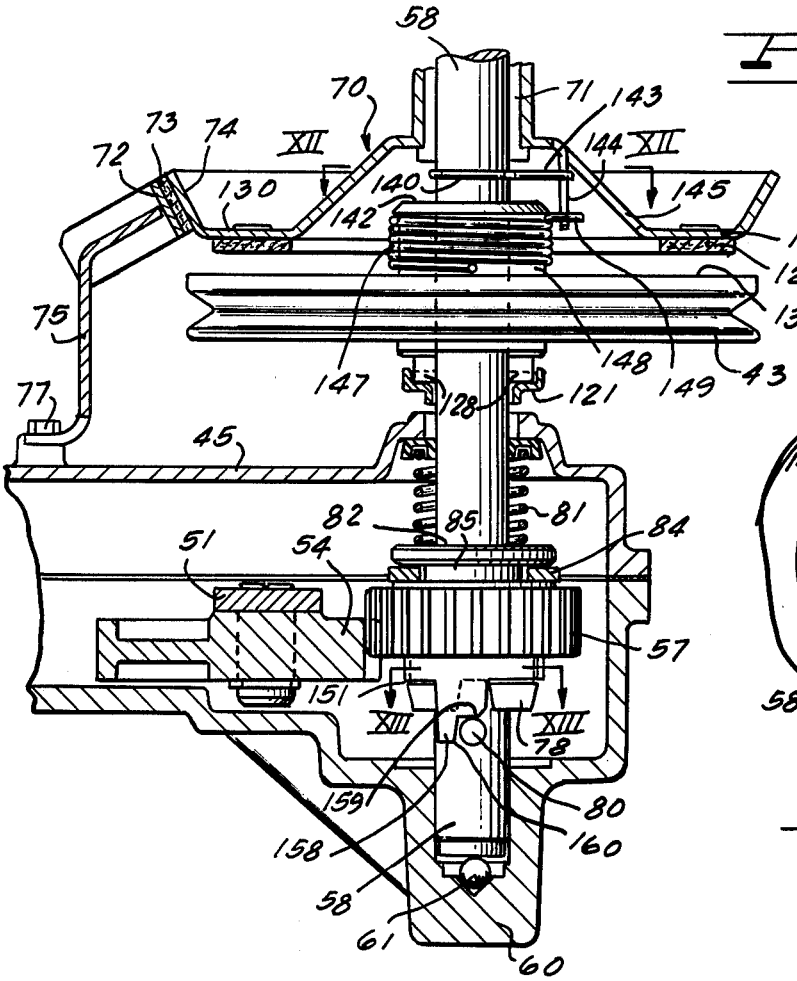
FIG. 11 is an enlarged fragmentary vertical sectional elevational view taken substantially along the line XI—XI of FIG. 5.
Figure 12:
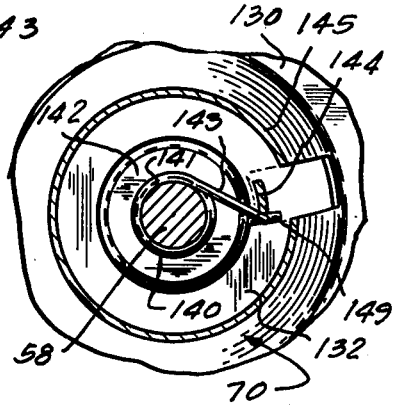
FIG. 12 is a horizontal sectional detail view taken substantially along the line XII—XII of FIG. 11.
Figure 13:
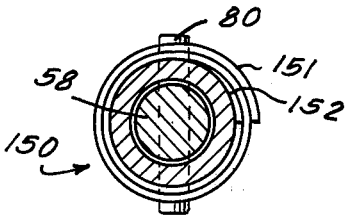
FIG. 13 is a fragmentary horizontal sectional detail view taken substantially along the line XIII—XIII of FIG. 11.
Figure 14:
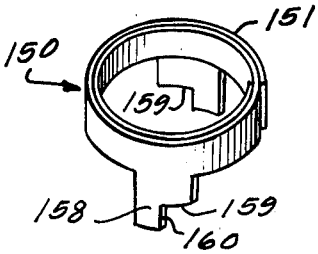
FIG. 14 is an isometric view of an anti-clash device associated with the agitator shaft driving gear clutch mechanism.

As is common practice, when the closure lid 18 of the washing machine 15 is opened, the motor 39 is instantly de-energized with a view of stopping all powered activity in the machine. According to present Underwriter's Laboratory requirements all motion must stop in seven seconds or less when the lid of the washing machine is opened. With wash loads of two pounds or less, the inertia of the spinning clothes container 28 and contained load may not be transmitted to the gear case drive because of insufficient clutch pressure between the disk clutch 70 and the driving pulley 43. Therefore the drive system may not operate long enough to shift the cam bar 91 into the brake mode, that is, to effect dropping of the pulley 43 into engagement of the brake flange 74 with the brake 72. To assure completion of the shift from the basket spin mode to the braking mode, an inertial spring clutch 147 (FIGS. 4, 9 and 11) is provided comprising a relatively tightly coiled multi-coil spring member frictionally engaging the upper hub portion 142 of the pulley 43 within an annular outer diameter groove 148. A generally radially extending clutch finger 149 is engageable with the disk clutch finger 144. During agitation and spin modes whenever the rotation of the container drive pulley 43 is greater than the speed of rotation of the clutch disk 70, the inertial clutch spring 147 tends to unwind when the spring clutch finger 149 engages the disk clutch finger 144 in the unwinding direction of the clutch spring 147, thereby facilitating frictional slippage of the coils of the spring 147 in the annular groove 148. When the lid 18 of the machine is opened and electrical power to the motor 39 is cut off and rotation of the drive pulley 43 tends to be less than rotation of the clutch disk 70 due to inertia of the basket or container 28 and its load, the spring clutch finger 149 will engage the disk clutch tab or finger 144 in the winding direction of the spring clutch 147 whereby the frictional clutching action of the spring clutch 147 on the hub 142 causes the pulley 43 to continue spinning with the clutch disk 70 and thus keeps the drive system operating until shifting of the cam bar 91 accomplishes shifting of the disk clutch 70 into the brake mode as depicted in FIGS. 4 and 11. Several advantages of the spring clutch 147 may be mentioned such as that it is quiet in operation, it has a smooth quiet clutching engagement of the spring clutch finger 149 with the disk clutch finger 144, it absorbs shock loading, it is a low cost simple device, it is easy to assemble, it is highly reliable and efficient in bringing the container 28 to a halt within the desired time interval.

During automatic operation of the washing machine 15, when the machine operation is "dial shifted" from the spin dry mode to the agitation mode, there may be a tendency under certain conditions for the clutch jaw 79 of the agitator driving gear 57 to engage the clutch pin 80 on the shaft 58 with substantial clash and sometimes extreme shock loading. This problem is completely alleviated by means of an anti-clash device 150 (FIGS. 3, 9, 11, 13 and 14) which is desirably in the form of a resilient spring band 151 which slidably frictionally engages about the lower hub portion 78 of the gear 57 within an annular external groove 152. The anti-clash clip 150 is easily installed by rotating it counterclockwise as it is pushed on to the hub portion 78. The anti-clash clip 150 is easily removed by pulling clutch finger 158 radially outward and rotating the anti-clash clip clockwise.

The purpose of the anti-clash device 150 is to restrain the gear 57 against clutch clashing dropping when shifting from the spin mode to the agitator operating mode of the washing machine, and in particular to keep the gear clutch from the clutching engagement until rotation of the agitator shaft 58 is slow enough to permit smooth and easy, substantially clash free clutching engagement of the clutch pin 80 in the clutch jaws 79. For example, the anti-clash device 150 may be so constructed and arranged that clutching will be restrained until rotation of the agitator shaft is less than 70 revolutions per minute. To this end, the band 151 is constructed in a manner that will enable it to frictionally clutch the hub portion 78 for normally maintaining the device 150 corotative with the gear 57. The inner portion of the resilient spring band 151 is in the groove 152 while the outer portion is on a diameter which is slightly larger than the underlying portion of the hub 78 outside of the groove 152 to provide clearance for depending integral stop fingers 158 of a length which places them in the path of movement of the clutch pin 80 in any position of the agitator drive gear 57, that is when the drive gear is in clutching relation to the shaft 58 as seen in FIG. 3, and in declutched or raised position of the driving gear 57 as seen in FIG. 9. When the agitator shaft 58 is rotating in the spin mode of operation of the machine, the clutch pin 80 engages the fingers 158 and spins the device 150 corotatively with the shaft 58. This brings downwardly facing respective shoulders 159, overhanging inset stop shoulders 160 formed to notches in the lower end portion of the fingers 158 and at the sides of the fingers from which the pin 80 approaches the fingers 158 in the spin mode of the shaft 58 into overlying relation to the pin 80. As a result, when the shifter mechanism 83 operates to declutch the driving pulley 43 as shown in FIG. 11, but the brake 72, 74 and the spring clutch 140, 143 have not reduced the rotational velocity of the agitator shaft 58 sufficiently to avoid clashing engagement of the clutch 79, 80, the shoulders 159 and stops 160 will maintain engagement with the clutch pin 80 and the device 150 overrides the gear 57 until the rotaty speed of the agitator shaft is sufficiently reduced. When the agitator shaft rotational speed has sufficiently reduced or stopped, the continuous oscillations of the gear 57 rotates the anti-clash device 150 to disengage the stop edge or shoulder 160 and the holding shoulder 159 from the pin 80 in each instance to permit the clutch jaws 79 to enter into engagement with the clutch pin 80 into the clutching mode depicted in FIG. 3. Substantial advantages that may be mentioned for the anti-clash device 150 are that it is consistent and reliable in operation, it is a simple low cost one piece construction, it is rugged in structure, substantially service free but can be easily replaced if necessary, it is easy and simple to assemble, and it provides a positive one-way spring clutch drive for the intended purpose.

In addition to or supplemental to the advantages that have been mentioned hereinbefore, it may be pointed out that the overall construction of the described embodiment of the invention provides for highly reliable efficient results in the automatic laundry machine environment, attaining these results with fewer parts than comparable prior arrangements and therefore significantly reduced initial cost and also reduced replacement costs in the remote possibility that replacement of any parts may be desirable at any time. By virtue of the simple load-sensitive brake and clutch arrangement, clutch adjustments are eliminated and the brake and clutch means are self-adjusting for any wear that may occur after prolonged service. When shifting into the spin mode, the clothes basket or container begins to spin slowly causing the clothes to move to the periphery of the basket which speeds up pump out and causes the clothes to be better distributed in the container. When shifting to the agitator mode there is a smooth clash-free transition. Smooth rapid stopping of all motion is effected when the lid of the machine is opened before the automatic washing and spin dry cycle has been completed. There is no dependence anywhere in the apparatus on tension springs.

It will be understood that variations and modifications may be effected without departing from the spirit and scope of the novel concepts of this invention.

I claim as my invention:

1. In a laundry machine including a tub, a clothes container within said tub mounted for spinning rotation at a relatively high extraction speed, and an agitator mounted within said clothes container for oscillating movement relative to the clothes container:

a shaft for driving said agitator;

a driving gear mounted for oscillation and reciprocation on and relative to said shaft;

clutch means carried in part by said driving gear and in part by said shaft for effecting a driving coupling selectively between said driving gear and said shaft;

a container driving member mounted for rotation and reciprocation on and relative to said shaft;

separable clutch means for effecting container spinning connection between said container and said container driving member;

means for continuously oscillating said driving gear and continuously rotating said driving member;

shifter means selectively operable for shifting said driving gear and said driving member substantially in unison axially along said shaft in one common reciprocative direction for declutching said driving gear from the shaft to discontinue agitator driving action of the shaft and concurrently effecting driving clutching connection of said driving member with said container for spinning operation of the container;

and said shifter means being alternately operable to effect shifting of said driving member and said driving gear substantially in unison axially along said shaft in the opposite reciprocative direction to declutch and discontinue spinning operation of the container and effect clutching connection of the driving gear with the shaft to oscillate the shaft and the agitator.

2. A laundry machine according to claim 1, wherein said shifter means comprise a single cam bar for effecting said shifting of said driving gear and said driving member substantially in unison axially along said shaft.

3. A laundry machine according to claim 2, wherein said cam bar is operable in a horizontal direction and controls vertical movement of a member having shifting connections with said driving gear and said driving member.

4. A laundry machine according to claim 1, including a spring clutch device carried by said shaft for causing the shaft to rotate with the container in spinning operation of the container.

5. A washing machine according to claim 4, wherein said spring clutch means also function as means for lifting the shaft to facilitate spinning of the shaft.

6. A washing machine according to claim 1, including an inertial spring clutch for transmitting kinetic energy from the spinning clothes container to said driving member during shifting from spinning operation to shaft and agitator oscillation.

7. A laundry machine according to claim 1, wherein said separable clutch means for effecting container spinning connection comprises a combination clutch and brake disk having a friction clutching surface clutchingly engageable with a friction clutching surface on said driving member, friction brake means mounted in stationary relation to said disk and having a friction brake surface, and a friction brake surface on said disk engageable with said friction brake surface of the friction brake means when the driving member is declutched relative to said disk.

8. In a laundry machine including a tub, a clothes container within said tub mounted for spinning rotation at a relatively high extraction speed, and an agitator mounted within said clothes container for oscillating movement relative to the clothes container:

a shaft for driving said agitator;

driving means for oscillating said shaft and thereby said agitator;

container driving means for effecting rotation of said container;

means for alternately effecting operation and inactivation of said respective driving means; and a spring friction clutch carried by said shaft and operative to effect corotation of the shaft and agitator and the container when the shaft driving means is unactivated and the container driving means is activated.

9. A laundry machine according to claim 8, wherein said spring friction clutch comprises a snap ring, the shaft having an annular groove in which said snap ring is seated, and means on said snap ring for effecting a driving coupling with said means for driving the container.

10. A laundry machine according to claim 8 wherein said spring friction clutch has means providing a lifting shoulder, and means for engaging said lifting shoulder and lifting the agitator shaft during corotation of the shaft and agitator with the container.

11. In a laundry machine including a tub, a clothes container within said tub mounted for spinning rotation at a relatively high extraction speed, and an agitator mounted within said clothes container for oscillating movement relative to the clothes container:

a shaft for driving said agitator;

a driving gear mounted for oscillation and reciprocation on and relative to said shaft;

clutch means carried in part by said driving gear and in part by said shaft for effecting a driving coupling selectively between said driving gear and said shaft;

a container driving member mounted for rotation and reciprocation on and relative to said shaft;

separable clutch means for effecting container spinning connection between said container and said container driving member;

motor means for driving said driving gear and means for driving said container driving member;

means for alternately effecting declutching of the driving gear from the shaft to discontinue agitator driving action of the shaft and concurrently effecting driving clutching connection of said driving member with said container for spinning operation of the container and alternatively operable to effect declutching of said driving member to discontinue spinning operation of the container and to effect clutching connection of the driving gear with the shaft to oscillate the shaft and the agitator; and a coil spring clutch associated with said container driving member and said container and operable during spinning operation of said container to effect continuing rotation of said container driving member in the event said motor means is disabled.

12. A laundry machine according to claim 11, wherein said coil spring clutch is mounted for rotation with one of said container driving member or said container and the other of said container driving member or said container includes means for operating said coil spring clutch.

13. A laundry machine according to claim 12, wherein said container driving member comprises a pulley with a hub portion formed thereon and said coil spring clutch is mounted on said hub portion.

14. In a laundry machine including a tub, a clothes container within said tub mounted for spinning rotation at a relatively high extraction speed, and an agitator mounted within said clothes container for oscillating movement relative to the clothes container:

a shaft for driving said agitator;

a driving gear including a hub mounted for oscillation and reciprocation on and relative to said shaft;

clutch means carried in part by said driving gear and in part by said shaft for effecting a driving coupling selectively between said driving gear and said shaft said clutch means comprising a jaw formed in said driving gear hub and a pin carried by said shaft and engageable with said jaw;

a container driving member mounted for rotation and reciprocation on and relative to said shaft;

separable clutch means for effecting container spinning connection between said container and said container driving member;

means for driving said driving gear and means for driving said container driving member;

means for alternately effecting declutching of the driving gear from the shaft to discontinue agitator driving action of the shaft and concurrently effecting driving clutching connection of said driving member with said container for spinning operation of the container and alternatively operable to effect declutching of said driving member to discontinue spinning operation of the container and to effect clutching connection of the driving gear with the shaft to oscillate the shaft and the agitator;

means for effecting corotation of the shaft with the container when the driving gear is declutched relative to the shaft;

and anti-clash means operative to restrain clutching connection of the gear clutch means after the container has been declutched and until spinning rotation of the shaft has decelerated sufficient to permit clutching of the gear with the shaft without clash, said anti-clash means comprising a spring clutch band mounted for frictional rotation on said driving gear hub said clutch band including a stop and shoulder portion engageable with said pin for restraining engagement of said pin with said jaw until said decelaration of the shaft has occurred.

* * * * *